United States Patent [19]

Keeler, II

[11] 4,056,275

[45] Nov. 1, 1977

[54] CLOSURE CATCH ASSEMBLY

[75] Inventor: Miner S. Keeler, II, Grand Rapids, Mich.

[73] Assignee: Keeler Brass Company, Grand Rapids, Mich.

[21] Appl. No.: 718,677

[22] Filed: Aug. 30, 1976

[51] Int. Cl.[2] ..... E05C 19/02

[52] U.S. Cl. ..... 292/17; 292/341.18

[58] Field of Search ..... 292/17–19, 292/76, 251.5, 341.18, 341.19, DIG. 38, DIG. 53, DIG. 60; 16/129–133; 52/756; 85/41; 248/287, 295, 298; 29/526

[56] References Cited

U.S. PATENT DOCUMENTS

| | | | |
|---|---|---|---|
| 295,833 | 3/1884 | Stiles | 85/41 |
| 371,646 | 10/1887 | Vance | 292/17 |
| 2,401,854 | 6/1946 | Barry, Jr. | 292/341.19 |
| 3,315,999 | 4/1967 | Hahn et al. | 292/76 |
| 3,414,309 | 12/1968 | Tresemer | 292/251.5 |
| 3,491,820 | 1/1970 | Ostling | 52/756 X |
| 3,734,551 | 5/1973 | Hughes et al. | 292/17 |

FOREIGN PATENT DOCUMENTS

| | | | |
|---|---|---|---|
| 551,033 | 9/1956 | Belgium | 85/41 |
| 2,020,591 | 11/1971 | Germany | 16/130 |

*Primary Examiner*—Roy D. Frazier
*Assistant Examiner*—William E. Lyddane
*Attorney, Agent, or Firm*—Price, Heneveld, Huizenga & Cooper

[57] ABSTRACT

The assembly includes a strike component comprising a headed screw and a catch component comprising a base member with a protruding catch member for engaging the head of the screw. The fastener compensates for misalignment by longitudinal motion of the catch component along an elongated screw receiving slot and by screwing the strike component in or out thereby positioning the head. The base member is mounted on an integral flange thereby spacing the slot from the mounting surface so the perimeter of the slot can be deformed when a mounting screw passes through. The perimeter of the slot thereby provides a biasing force resisting longitudinal motion of the base member.

6 Claims, 6 Drawing Figures

CLOSURE CATCH ASSEMBLY

BACKGROUND OF THE INVENTION

This invention relates to fastening means; and, more particularly, to closure fasteners for cabinets or the like.

One type of closure fastener used today in cabinetry is like that shown in U.S. Pat. No. 3,734,551 entitled "CLOSURE-FASTENER FOR CABINETS OR THE LIKE" and issued May 22, 1973. Such fastener includes a catch member or female component, having two middle flanges spring biased toward each other extending from a base member. The base member is connected to the cabinet by screws extending through openings in the base member. A strike component, or male component, includes a protrusion from a base adapted to be received between the two flanges of the catch component. The base of the strike component also has an opening for passing a screw to mount the strike component. Such closures typically have many drawbacks including difficulty in alignment, cost, and inability to hold alignment under rugged use.

SUMMARY OF THE INVENTION

A fastener assembly in accordance with an embodiment of this invention includes a screw-like elongated strike component having a generally spherical head portion which can be adjusted in longitudinal position by turning the strike component. The fastener further includes a catch component having a U-shaped member for engaging the spherical head. The U-shaped member projects substantially perpendicularly from a cup-shaped, elongated base member having a wall spaced from the surface on which the base member is to be mounted. Elongated, longitudinal screw receiving slots extend through such wall of the base member. The wall and thus the perimeter of the slots are flexible thereby providing a flexible screw engaging means for providing a biasing force which prevents the base member from sliding and thus preventing misalignment of the catch. The U-shaped member has a pair of opposing flexible flanges or fingers extending forwardly from a connecting rearward portion thereby defining a catch which can slide over and secure to the head of the strike component.

The fastener is particularly advantageous because the strike component is only one item and the catch component is one item plus any mounting screws required for mounting. Thus, in the preferred embodiment, two mounting screws are used so there is a total of four pieces. Further, the pieces adjust with respect to one another thereby facilitating installation and compensating for any misalignment. The catch component adjusts longitudinally (e.g. up and down) along the slots and the strike component adjusts in and out by screwing. The U-shaped member is sufficiently long to compensate for some misalignment (e.g. left and right) of the catch component and the strike component. Further, the said wall and thus the perimeter of the slot is formed of flexible material which forms a flexible screw engaging means for providing a force restraining longitudinal movement of the catch component relative to the fastening screws. The use of the slots makes possible an easy adjustment. Without the slots, the screws would have to be removed and changed in location. As a result of the few pieces and their adjustability, the fastener can be produced at a relatively low cost and can be relatively quickly and easily installed even by persons with relatively little skill. Further, the fastener has better holding ability, i.e., the ability to hold its position on the cabinet so as to avoid misalignment of the catch with the strike.

DETAILED DESCRIPTION

Figure 1:
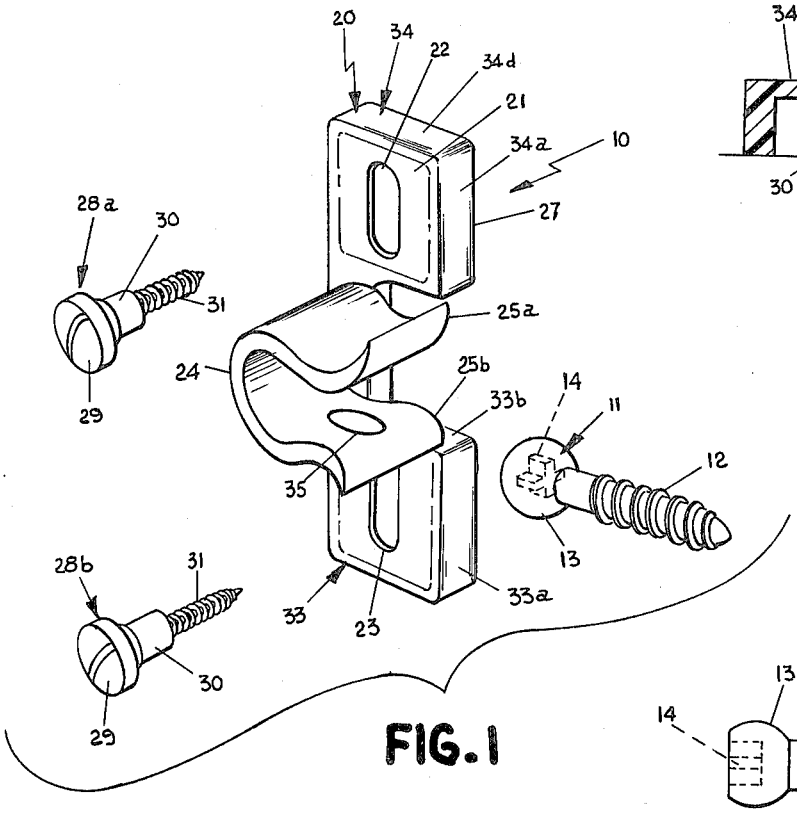
FIG. 1 is a frontal perspective exploded view of a fastener in accordance with an embodiment of this invention.

Referring to the drawing, a fastener assembly 10 includes a strike component 11 and a catch component 20. Strike component 11 includes a threaded portion 12 and a generally spherical head 13 having an indentation 14 for receiving a screwdriver, or the like for turning strike component 11.

Catch component 20 includes two cup-shaped ends 31 and 32 each having an elongated base having a top wall 33 and 34, respectively, with depending side walls **33*a*, 33*b*, 33*c* and 33*d* and 34*a*, 34*b*, 34*c* and 34*d*, respectively. The top walls 33 and 34 have the slots or elongated openings 23 and 22, respectively. Connecting the two cup-shaped members 31 and 32 is a connecting web 35 from which a U-shaped member 24 projects perpendicularly therefrom. U-shaped member 24 includes a pair of curved flanges 25*a* and 25*b* which oppose each other and are connected by a back portion 26.**

Figure 4:
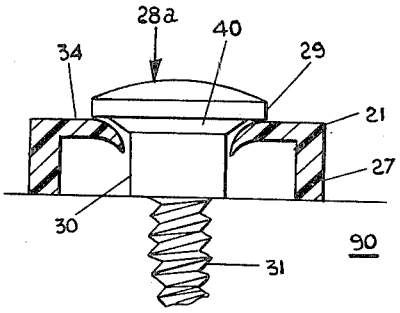
FIG. 4 is a cross section view along section line IV—IV of FIG. 3 and a side elevation view of a mounting screw in accordance with an embodiment of this invention.
Figure 2:
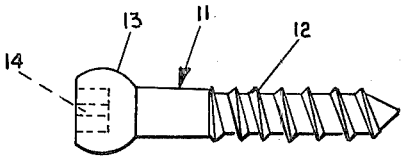
FIG. 2 is a side elevation view of a strike component of a fastener in accordance with an embodiment of this invention.
Figure 3:
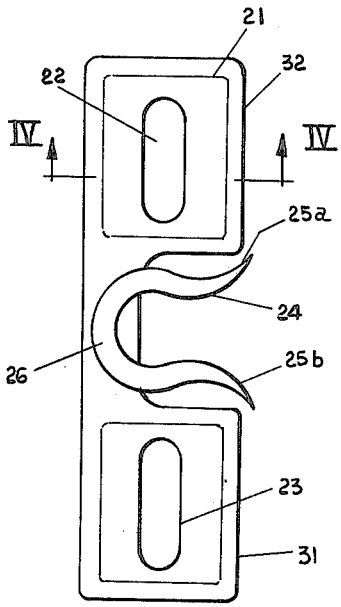
FIG. 3 is a front elevational view of a catch component in accordance with an embodiment of this invention.
Figure 5:
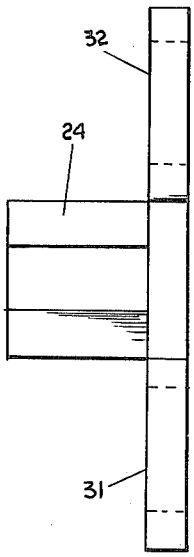
FIG. 5 is a side elevation view of a catch component of a fastener in accordance with an embodiment of this invention.
Figure 6:
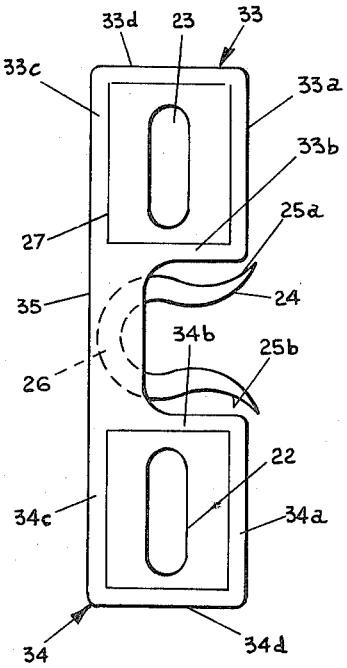
FIG. 6 is a back elevation view of a catch component in accordance with an embodiment of this invention.

The catch component 20 is mounted to a cabinet or the like using a pair of specially shaped and dimensioned screws **28*a* and 28*b*. The screws 28*a* and 28*b* are formed with an enlarged head portion 29, a tapered portion 40, a neck 30 and a threaded portion 31. The diameter of the enlarged head portion 29 is slightly greater than the width of the slots 22 and 23 while the neck 30 is of slightly less diameter than the width of the slots so as to permit the neck to extend through the slots. The diameter of tapered portion 40 increases from the diameter of neck 30 to a diameter somewhat less than the diameter of head portion 29. For this purpose, the diameter of the neck is 0.164 inches and the width of the slot is .166 inches while the diameter of the head is 0.297 inches. The length of neck 30 is slightly less than $\frac{1}{8}$ inches which is slightly less than the thickness of the two cup-shaped ends. The combined length of neck 30 and tapered portion 40 is about $\frac{1}{8}$ inches and therefore equal to about the thickness of the two cup-shaped ends. Further, the side walls of tapered portion 40 form an angle of about 120° with respect to the side walls of neck 30. The neck 30 thus limits the extent of how far the screw is screwed into a mounting frame 90 and the extent of deflection of the top walls 33 and 34 by the screw tapered portion 40. Thus, when the screw is screwed into frame 90 so that the shoulder of the neck 30 abuts against the frame as shown in FIG. 4, the top walls 33 and 34 of the cup-shaped ends 31 and 32 are flexed causing the enlarged head 29 and tapered portion 40 to securely hold the catch in position. However, if it is desirable to adjust the catch when it is being installed or subsequent thereto, the screws are not tightened or are backed off very slightly causing the tapered portion 40 to slightly contact walls 33 and 34 permitting adjustment of the catch. While permitting adjustment, the heads by their contact with walls 33 and 34 temporarily hold the catch in each position of adjustment until the screws can be screwed in more tightly into a position where the shoulder of the neck 30** abuts against the frame or cabinet.

In order to provide the top walls with sufficient resiliency to permit deformation thereof when the screws **28*b* and 28*a* are tightened to their fullest extent, the catch is constructed of a plastic material such as polypropylene having a top wall thickness of 0.020 inches. The catch is preferably integrally formed of such plastic material in order to permit the deformation of both the flanges 25*a* and 25*b* and the top walls adjacent the slots 22 and 23. In this integrally formed molded component, the U-shaped member 24 is connected principally at back portion 26 to base member 21. That is, flanges 25*a* and 25*b* are free to move with respect to base member 21. Because the perimeter of openings 22 and 23 is deformable, screws 28*a* and 28*b* can be inserted any place along the entire length of openings 22 and 23 and will provide a force against slipping of catch component 20 relative to mounting screws 28*a* and 28*b* because of deformable indentations at the edge of openings 22 and 23 where screws 28*a* and 28*b* pass through. If desired, U-shaped member 24 can have interior grooves 35 generally parallel to the axis of strike component 11 for receiving and guiding head 13**.

OPERATION

Installation of fastener assembly 10 is facilitated because openings 22 and 23 permit longitudinal (e.g. up and down) movement of catch component 20 after mounting screws **28*a* and 28*b* are partially inserted. As explained above, when the screws 28*a* and 28*b* are screwed into position with tapered portion 40 abutting against top walls 33 and 34, but with the shoulder of neck 30 slightly spaced from the frame of the cabinet, the catch component can be slidably adjusted and is temporarily held in position until the screws are further screwed into position with the shoulder of neck 30 tight against frame 90. Further, head 13 of strike component 11 can be positioned in or out with respect to an interior receiving cavity substantially defined by U-shaped member 24, by screwing strike component 11 in or out. Additionally, U-shaped member 24 extends substantially beyond the surface of base member 21 to provide a sufficiently long receiving cavity to compensate for minor mislocations (e.g. side to side) of strike component 11. As a result, fastener assembly 10** provides for a three-way adjustment or compensation (e.g. up and down, in and out, side to side) and makes installation advantageously simple.

Typically, catch component 20 is installed into the interior of a cabinet or the like by means of mounting screws **28*a* and 28*b* partially tightened as described above. Strike component 11 is then inserted into U-shaped member 24 and the cabinet door closed to see where strike component 11 should be located in the door. Strike component 11 is screwed into the door until head 13 is positioned to be engaged by U-shaped member 24. Minor longitudinal adjustment (e.g. up and down) of catch component 20 can then be made before fully tightening screws 28*a* and 28*b*. Similarly, minor in and out adjustment of head 13 can be made by screwing strike component 11** in or out.

Various modifications will no doubt occur to those skilled in the art to which this invention pertains. For example, the particular shape of the flange and of the U-shaped member vary from that disclosed herein. These and all other variations which basically rely on the teachings by which this disclosure has advanced the art are properly considered within the scope of this invention.

The embodiments of the invention in which an exclusive property or privilege is claimed are defined as follows.

1. A fastener for a cabinet or the like, comprising:

an elongated strike component including a head portion and a threaded screw portion for mounting and adjusting the position of said head portion;

a catch component including a substantially flat, elongated base member having an elongated, longitudinal screw receiving slot extending through said base member, said base member having a flexible, screw engaging means surrounding the perimeter of said slot for providing a biasing force restraining longitudinal movement of said base member, and an integral catch member projecting substantially perpendicularly from said base member;

said catch member having a pair of opposing flanges extending forwardly from a connecting rearward portion thereby defining an interior cavity, intermediate said flanges and said rearward portion, opening through both sides of said catch member, for receiving said head portion of said elongated strike component; and a mounting screw for passing through said screw receiving slot, said mounting screw having stop means for limiting travel of said mounting screw into the cabinet and slot engaging means for engaging said screw engaging means and thereby deforming the perimeter of said slot.

2. A fastener as recited in claim 1 wherein said screw engaging means comprises:

said base member having a top wall;

a flange projecting from the top wall of said base member opposite said U-shaped member, substantially around the perimeter of said base member and laterally spaced from the perimeter of said screw receiving slot, said flange abutting the cabinet thereby spacing said top wall and screw receiving slot from the cabinet and providing space for deflection of the top wall at the perimeter of said screw receiving slot toward the cabinet.

3. A fastener as recited in claim 2 wherein said stop means comprises a neck portion on said mounting screw for limiting travel of said mounting screw into the cabinet; and said slot engaging means includes a head portion having a diameter greater than the diameter of said neck portion and a tapered portion connected intermediate said neck portion and said head portion, said tapered portion having an increasing diameter with increasing distance from said neck portion.

4. A fastener as recited in claim 3 wherein the combined length of said tapered and neck portions is substantially equal to the combined thickness of said top wall and said flange of said catch component, the diameter of said neck portion is less than the width of said screw receiving slot, the diameter of said head portion is greater than the width of said screw receiving slot and less than the width of said catch component, and the diameter of said tapered portion is greater than the diameter of said neck portion.

5. A fastener for a cabinet or the like, comprising:

an elongated strike component, including a head portion and a threaded screw portion for mounting and adjusting the position of said head portion;

a catch component including a substantially flat, elongated base member having a top wall with a pair of longitudinally spaced, longitudinally elongated screw receiving slots extending through said base, said top wall being flexible; an integral U-shaped member projecting substantially perpendicularly from said base member and positioned intermediate said slots; a flange means projecting from the top wall of said base member in a direction opposite to said U-shaped member; said flange means being located substantially around the perimeter of said top wall and laterally spaced from the perimeter of said screw receiving slots, said flange means abutting the cabinet thereby spacing said screw receiving slots from the cabinet and providing space for deflection of the top wall around the perimeter of said screw receiving slots toward the cabinet; and a mounting screw for passing through said screw receiving slot, said mounting screw having stop means for limiting travel of said mounting screw into the cabinet and slot engaging means for engaging and deforming the top wall at the perimeter of said slot, said stop means being effective only after said slot engaging means engages and deforms said top wall.

6. A fastener as recited in claim 5 wherein said mounting screw has a neck portion, for limiting travel of said mounting screw into the cabinet, having a diameter less than the width of said slots, a head portion having a diameter greater than the width of said slots and less than the width of said catch component, and a tapered portion connected intermediate said neck portion and said head portion having an increasing diameter with increasing distance from said neck portion, the combined length of said tapered and neck portions being substantially equal to the combined thickness of said top wall and said flange of said catch component.

* * * * *